US007623113B2

(12) United States Patent
Zhou et al.

(10) Patent No.: US 7,623,113 B2
(45) Date of Patent: Nov. 24, 2009

(54) METHOD OF COMPENSATING TEMPERATURE DEPENDENCE OF DRIVING SCHEMES FOR ELECTROPHORETIC DISPLAYS

(75) Inventors: Guofu Zhou, Best (NL); Rogier H. M. Cortie, Ittervoort (NL); Mark T. Johnson, Veldhoven (NL); Jan van de Kamer, Heerlen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 579 days.

(21) Appl. No.: 10/571,327

(22) PCT Filed: Sep. 9, 2004

(86) PCT No.: PCT/IB2004/051733

§ 371 (c)(1),
(2), (4) Date: Mar. 8, 2006

(87) PCT Pub. No.: WO2005/027087

PCT Pub. Date: Mar. 24, 2005

(65) Prior Publication Data

US 2006/0291122 A1 Dec. 28, 2006

Related U.S. Application Data

(60) Provisional application No. 60/502,312, filed on Sep. 12, 2003, provisional application No. 60/535,771, filed on Jan. 12, 2004.

(51) Int. Cl.
*G09G 3/34* (2006.01)

(52) U.S. Cl. ..... 345/107; 359/296

(58) Field of Classification Search ..... 345/107
See application file for complete search history.

(56) References Cited

U.S. PATENT DOCUMENTS

| | | | | |
|---|---|---|---|---|
| 5,961,804 | A | 10/1999 | Jacobson et al. | |
| 6,130,774 | A | 10/2000 | Albert et al. | |
| 6,320,571 | B1 * | 11/2001 | Takahashi et al. | 345/204 |
| 7,002,728 | B2 * | 2/2006 | Pullen et al. | 359/296 |
| 7,012,600 | B2 * | 3/2006 | Zehner et al. | 345/214 |
| 2002/0185378 | A1 * | 12/2002 | Honeyman et al. | 204/601 |
| 2007/0200795 | A1 * | 8/2007 | Whitesides et al. | 345/55 |

FOREIGN PATENT DOCUMENTS

| | | | |
|---|---|---|---|
| EP | 0613116 | A2 | 8/1994 |
| EP | 0613116 | A3 | 8/1994 |
| EP | 0613116 | B1 | 8/1994 |
| JP | 0613116 | A2 * | 2/1994 |
| WO | WO9953373 | A1 | 10/1999 |
| WO | WO 03/044765 | * | 5/2003 |
| WO | WO03079323 | A1 | 9/2003 |

* cited by examiner

*Primary Examiner*—Alexander Eisen
*Assistant Examiner*—Jeffrey Steinberg

(57) ABSTRACT

An image is updated on a bi-stable display (310) such as an electrophoretic display by providing separate scaling functions (SF1, SF2) for scaling a duration of a reset pulse (R) and a duration of a driving pulse (D) in a drive waveform based on temperature (335). An absolute value of a slope with varying temperatures of the scaling factor (SF1) for the reset pulse (R) is significantly greater than that of the scaling factor (SF2) for the driving pulse (D), while both scaling factors increase with decreasing temperature. Image update time (IUT) is significantly reduced at lower temperatures, while a range of variation of IUT across all temperatures is also reduced. Scaling functions (SF3, SF4) may also be used for scaling a duration of a help reset pulse (H) and/or a duration of one or more shaking pulses (SH1, SH2).

17 Claims, 6 Drawing Sheets

METHOD OF COMPENSATING TEMPERATURE DEPENDENCE OF DRIVING SCHEMES FOR ELECTROPHORETIC DISPLAYS

CROSS REFERENCE TO RELATED APPLICATION

This application claims the benefit of the filing date U.S. provisional patent application Ser. No. 60/502,312 filed Sep. 12, 2003 and U.S. provisional patent application Ser. No. 60/535,771 filed Jan. 12, 2004 both of which are incorporated herein in whole by reference.

The invention relates generally to electronic reading devices such as electronic books and electronic newspapers and, more particularly, to a method and apparatus for compensating for the effects of temperature dependence in driving a display in such devices.

Recent technological advances have provided "user friendly" electronic reading devices such as e-books that open up many opportunities. For example, electrophoretic displays hold much promise. Such displays have an intrinsic memory behavior and are able to hold an image for a relatively long time without power consumption. Power is consumed only when the display needs to be refreshed or updated with new information. So, the power consumption in such displays is very low, suitable for applications for portable e-reading devices like e-books and e-newspaper. Electrophoresis refers to movement of charged particles in an applied electric field. When electrophoresis occurs in a liquid, the particles move with a velocity determined primarily by the viscous drag experienced by the particles, their charge (either permanent or induced), the dielectric properties of the liquid, and the magnitude of the applied field. An electrophoretic display is a type of bi-stable display, which is a display that substantially holds an image without consuming power after an image update.

For example, international patent application WO 99/53373, published Apr. 9, 1999, by E Ink Corporation, Cambridge, Mass., US, and entitled Full Color Reflective Display With Multichromatic Sub-Pixels, describes such a display device. WO 99/53373 discusses an electronic ink display having two substrates. One is transparent, and the other is provided with electrodes arranged in rows and columns. A display element or pixel is associated with an intersection of a row electrode and column electrode. The display element is coupled to the column electrode using a thin film transistor (TFT), the gate of which is coupled to the row electrode. This arrangement of display elements, TFT transistors, and row and column electrodes together forms an active matrix. Furthermore, the display element comprises a pixel electrode. A row driver selects a row of display elements, and a column or source driver supplies a data signal to the selected row of display elements via the column electrodes and the TFT transistors. The data signals correspond to graphic data to be displayed, such as text or figures.

The electronic ink is provided between the pixel electrode and a common electrode on the transparent substrate. The electronic ink comprises multiple microcapsules of about 10 to 50 microns in diameter. In one approach, each microcapsule has positively charged white particles and negatively charged black particles suspended in a liquid carrier medium or fluid. When a positive voltage is applied to the pixel electrode, the white particles move to a side of the microcapsule directed to the transparent substrate and a viewer will see a white display element. At the same time, the black particles move to the pixel electrode at the opposite side of the microcapsule where they are hidden from the viewer. By applying a negative voltage to the pixel electrode, the black particles move to the common electrode at the side of the microcapsule directed to the transparent substrate and the display element appears dark to the viewer. At the same time, the white particles move to the pixel electrode at the opposite side of the microcapsule where they are hidden from the viewer. When the voltage is removed, the display device remains in the acquired state and thus exhibits a bi-stable character. In another approach, particles are provided in a dyed liquid. For example, black particles may be provided in a white liquid, or white particles may be provided in a black liquid. Or, other colored particles may be provided in different colored liquids, e.g., white particles in blue liquid.

Other fluids such as air may also be used in the medium in which the charged black and white particles move around in an electric field (e.g., Bridgestone SID2003—Symposium on Information Displays. May 18-23, 2003,—digest 20.3). Colored particles may also be used.

To form an electronic display, the electronic ink may be printed onto a sheet of plastic film that is laminated to a layer of circuitry. The circuitry forms a pattern of pixels that can then be controlled by a display driver. Since the microcapsules are suspended in a liquid carrier medium, they can be printed using existing screen-printing processes onto virtually any surface, including glass, plastic, fabric and even paper. Moreover, the use of flexible sheets allows the design of electronic reading devices that approximate the appearance of a conventional book.

However, it is problematic that image quality and update time are significantly reduced at lower temperatures with current display driving schemes that compensate for the effects of varying temperatures.

The invention addresses this problem by providing a method and apparatus for compensating for the effects of temperature in driving an electrophoretic or other bi-stable display while improving image quality and update time.

In a particular aspect of the invention, a method for driving a bi-stable display includes determining a temperature associated with the bi-stable display, determining a duration for applying a reset pulse to at least a portion of the bi-stable display based on the determined temperature and a first scaling function, and determining a duration for applying a driving pulse to the at least a portion of the bi-stable display based on the determined temperature and a second scaling function that differs from the first scaling function.

In further aspects of the invention, additional portions of the driving waveform, such as shaking pulses and additional help reset pulses, prior to the reset pulse, may use additional scaling functions, which differ from both the first and second scaling functions.

A related electronic reading device and program storage device are also provided.

In the drawings.

In all the Figures, corresponding parts are referenced by the same reference numerals.

Each of the following is incorporated herein by reference:

European patent application EP 03100133.2, entitled "Electrophoretic display panel", filed Jan. 23, 2003;

European patent application EP 02077017.8, entitled "Display Device", filed May 24, 2002, or WO 03/079323, Electrophoretic Active Matrix Display Device", published Feb. 6, 2003;

European patent application EP 02079203.2, entitled "Electrophoretic display panel", filed Oct. 10, 2002;

U.S. provisional patent application No. 60/503,844, entitled "An Electrophoretic Display with Reduced Look-Up-Table Memory", filed Sep. 18, 2003;

U.S. provisional patent application No. 60/473,208, entitled "Improved driving scheme for an electrophoretic display", filed May 23, 2003; and EPO patent application no. 03102139.7, entitled "Electrophoretic display with improved grey scale", filed Jul. 14, 2003.

Figure 1:
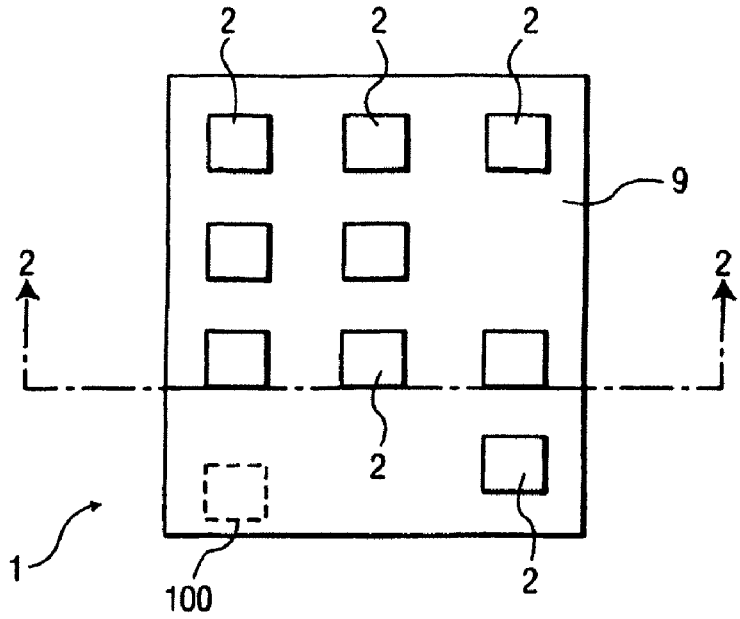
FIG. 1 Prior Art
FIG. 1 shows diagramatically a front view of an embodiment of a portion of a display screen of an electronic reading device.
Figure 2:
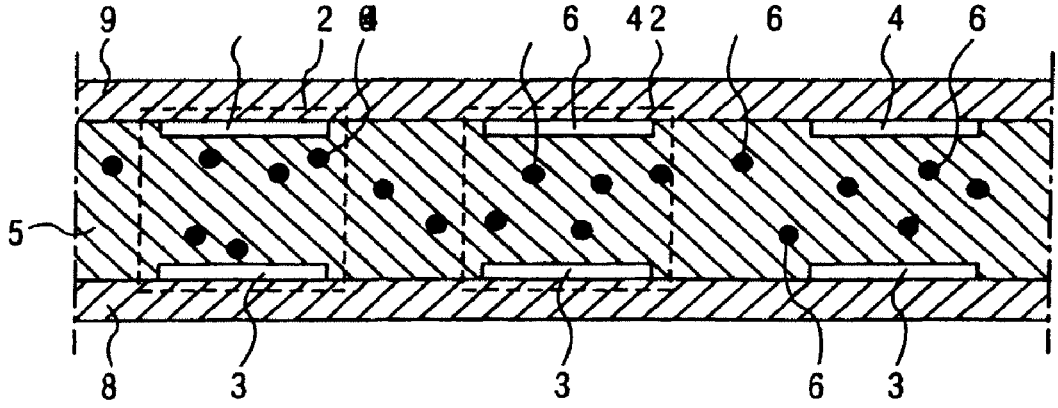
FIG. 2 Prior Art
FIG. 2 shows diagramatically a cross-sectional view along 2-2 in FIG. 1.

FIGS. 1 and 2 show the embodiment of a portion of a display panel 1 of an electronic reading device having a first substrate 8, a second opposed substrate 9 and a plurality of picture elements 2. The picture elements 2 may be arranged along substantially straight lines in a two-dimensional structure. The picture elements 2 are shown spaced apart from one another for clarity, but in practice, the picture elements 2 are very close to one another so as to form a continuous image. Moreover, only a portion of a full display screen is shown. Other arrangements of the picture elements are possible, such as a honeycomb arrangement. An electrophoretic medium 5 having charged particles 6 is present between the substrates 8 and 9. A first electrode 3 and second electrode 4 are associated with each picture element 2. The electrodes 3 and 4 are able to receive a potential difference. In FIG. 2, for each picture element 2, the first substrate has a first electrode 3 and the second substrate 9 has a second electrode 4. The charged particles 6 are able to occupy positions near either of the electrodes 3 and 4 or intermediate to them. Each picture element 2 has an appearance determined by the position of the charged particles 6 between the electrodes 3 and 4. Electrophoretic media 5 are known per se, e.g., from U.S. Pat. Nos. 5,961,804, 6,120,839, and 6,130,774 and can be obtained, for instance, from E Ink Corporation.

As an example, the electrophoretic medium 5 may contain negatively charged black particles 6 in a white fluid. When the charged particles 6 are near the first electrode 3 due to a potential difference of, e.g., +15 Volts, the appearance of the picture elements 2 is white. When the charged particles 6 are near the second electrode 4 due to a potential difference of opposite polarity, e.g., −15 Volts, the appearance of the picture elements 2 is black. When the charged particles 6 are between the electrodes 3 and 4, the picture element has an intermediate appearance such as a grey level between black and white. An application-specific integrated circuit (ASIC) 100 controls the potential difference of each picture element 2 to create a desired picture, e.g. images and/or text, in a full display screen. The full display screen is made up of numerous picture elements that correspond to pixels in a display.

Figure 3:
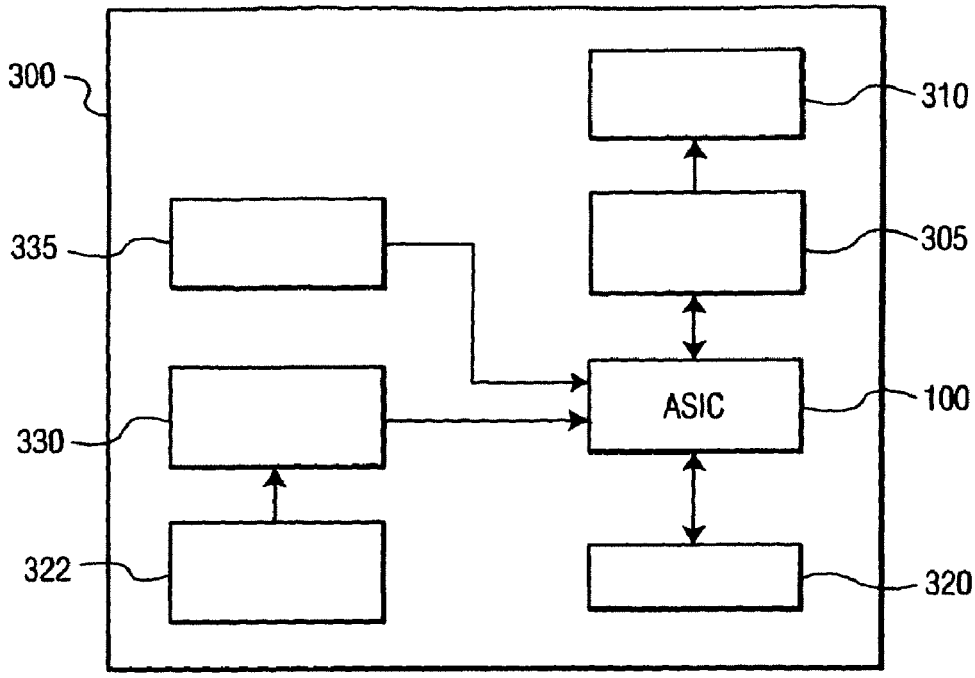
FIG. 3 shows diagramatically an overview of an electronic reading device.

FIG. 3 shows diagramatically an overview of an electronic reading device. The electronic reading device 300 includes the display ASIC 100. For example, the ASIC 100 may be the Philips Corp. "Apollo" ASIC E-ink display controller. The display ASIC 100 controls the one or more display screens 310, such as electrophoretic screens, via an addressing circuit 305, to cause desired text or images to be displayed. The addressing circuit 305 includes driving integrated circuits (ICs). For example, the display ASIC 100 may provide, via an addressing circuit 305, voltage waveforms to the different pixels in the display screen 310. The addressing circuit 305 provides information for addressing specific pixels, such as row and column, to cause the desired image or text to be displayed. The display ASIC 100 causes successive pages to be displayed starting on different rows and/or columns. The image or text data may be stored in a memory 320, which represents one or more storage devices. One example is the Philips Electronics small form factor optical (SFFO) disk system, in other systems a non-volatile flash memory could be utilized. The electronic reading device 300 further includes a reading device controller 330 or host controller, which may be responsive to a user-activated software or hardware button 322 that initiates a user command such as a next page command or previous page command.

The reading device controller 330 may be part of a computer that executes any type of computer code devices, such as software, firmware, micro code or the like, to achieve the functionality described herein. Accordingly, a computer program product comprising such computer code devices may be provided in a manner apparent to those skilled in the art. The reading device controller 330 may further comprise a memory (not shown) that is a program storage device that tangibly embodies a program of instructions executable by a machine such as the reading device controller 330 or a computer to perform a method that achieves the functionality described herein. Such a program storage device may be provided in a manner apparent to those skilled in the art.

The display ASIC 100 may have logic for periodically providing a forced reset of a display region of an electronic book, e.g., after every x pages are displayed, after every y minutes, e.g., ten minutes, when the electronic reading device 300 is first turned on, and/or when the brightness deviation is larger than a value such as 3% reflection. For automatic resets, an acceptable frequency can be determined empirically based on the lowest frequency that results in acceptable image quality. Also, the reset can be initiated manually by the user via a function button or other interface device, e.g., when the user starts to read the electronic reading device, or when the image quality drops to an unacceptable level.

The ASIC 100 provides instructions to the display addressing circuit 305 for driving the display 310 based on information stored in the memory 320.

A temperature sensor 335, such as a thermocouple or CMOS based temperature sensor, may be used to determine the temperature of the ambient environment in which the electronic reading device 300 is located and send a corresponding signal to the control 100.

Figure 4:
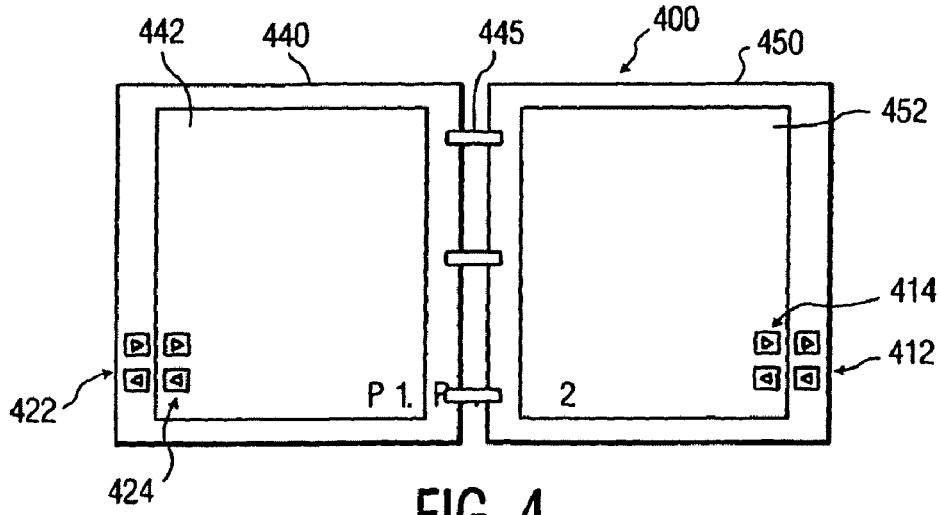
FIG. 4 shows diagramatically two display screens with respective display regions.

The invention may be used with any type of electronic reading device. FIG. 4 illustrates one possible example of an electronic reading device 400 having two separate display screens. Specifically, a first display region 442 is provided on a first screen 440, and a second display region 452 is provided on a second screen 450. The screens 440 and 450 may be connected by a binding 445 that allows the screens to be folded flat against each other, or opened up and laid flat on a surface. This arrangement is desirable since it closely replicates the experience of reading a conventional book.

Various user interface devices may be provided to allow the user to initiate page forward, page backward commands and the like. For example, the first region 442 may include on-screen buttons 424 that can be activated using a mouse or other pointing device, a touch activation, PDA pen, or other known technique, to navigate among the pages of the electronic reading device. In addition to page forward and page backward commands, a capability may be provided to scroll up or down in the same page. Hardware buttons 422 may be provided alternatively, or additionally, to allow the user to provide page forward and page backward commands. The second region 452 may also include on-screen buttons 414 and/or hardware buttons 412. Note that the frame around the first and second display regions 442, 452 is not required as the display regions may be frameless. Other interfaces, such as a voice command interface, may be used as well. Note that the buttons 412, 414; 422, 424 are not required for both display regions. That is, a single set of page forward and page backward buttons may be provided. Or, a single button or other device, such as a rocker switch, may be actuated to provide both page forward and page backward commands. A function button or other interface device can also be provided to allow the user to manually initiate a reset.

In other possible designs, an electronic book has a single display screen with a single display region that displays one page at a time. Or, a single display screen may be partitioned into or two or more display regions arranged, e.g., horizontally or vertically. Furthermore, when multiple display regions are used, successive pages can be displayed in any desired order. For example, in FIG. 4, a first page can be displayed on the display region 442, while a second page is displayed on the display region 452. When the user requests to view the next page, a third page may be displayed in the first display region 442 in place of the first page while the second page remains displayed in the second display region 452. Similarly, a fourth page may be displayed in the second display region 452, and so forth. In another approach, when the user requests to view the next page, both display regions are updated so that the third page is displayed in the first display region 442 in place of the first page, and the fourth page is displayed in the second display region 452 in place of the second page. When a single display region is used, a first page may be displayed, then a second page overwrites the first page, and so forth, when the user enters a next page command. The process can work in reverse for page back commands. Moreover, the process is equally applicable to languages in which text is read from right to left, such as Hebrew, as well as to languages such as Chinese in which text is read column-wise rather than row-wise.

Additionally, note that the entire page need not be displayed on the display region. A portion of the page may be displayed and a scrolling capability provided to allow the user to scroll up, down, left or right to read other portions of the page. A magnification and reduction capability may be provided to allow the user to change the size of the text or images. This may be desirable for users with reduced vision, for example.

Problem to be Solved

Grey levels in an E-ink type electrophoretic display are generally created by applying voltage pulses for specified time periods. The accuracy of the greyscale in an electrophoretic display is strongly influenced by image history, dwell time, temperature, humidity, and lateral inhomogeneity of the electrophoretic foils. Accurate grey levels can be achieved using a rail-stabilized approach, where the grey levels are always achieved either from a reference black state or from a reference white state (the two rails). A driving method using a single over-reset voltage pulse has been found to be promising for driving an electrophoretic display, as discussed in the above-mentioned European patent application EP 03100133.2. The pulse sequence usually includes three portions, namely shaking pulses (SH1), a reset pulse (R), and a greyscale driving pulse (D). Moreover, it is sometimes desired to apply a second set of shaking pulses (SH2) between the reset and greyscale driving pulses for further reducing image retention and improving image quality. Shaking pulses are discussed in the above-mentioned European patent application 02077017.8. The shaking pulses can be hardware or software shaking pulses. Hardware shaking pulses are addressed to more than one row of pixels in the display together, while software shaking pulses are addressed to at most one row of pixels simultaneously. Optionally, the over-reset pulse may be preceded by a further reset pulse (help pulse) of opposite polarity to the reset pulse. This help pulse may be of a reduced duration than the standard or over-reset pulse, as it is not designed to bring particles to the rail states.

Figure 5:
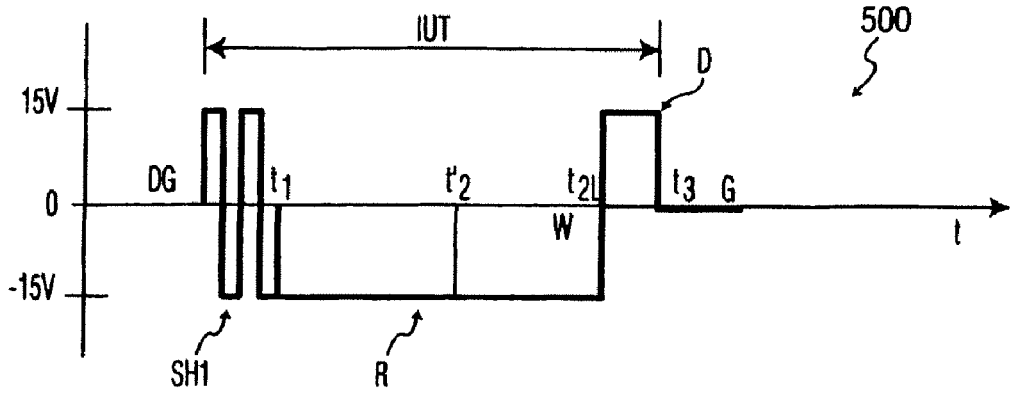
FIG. 5 illustrates an example waveform using rail-stabilized driving, where the waveform includes first shaking pulses, a reset pulse, and a driving pulse.
Figure 6:
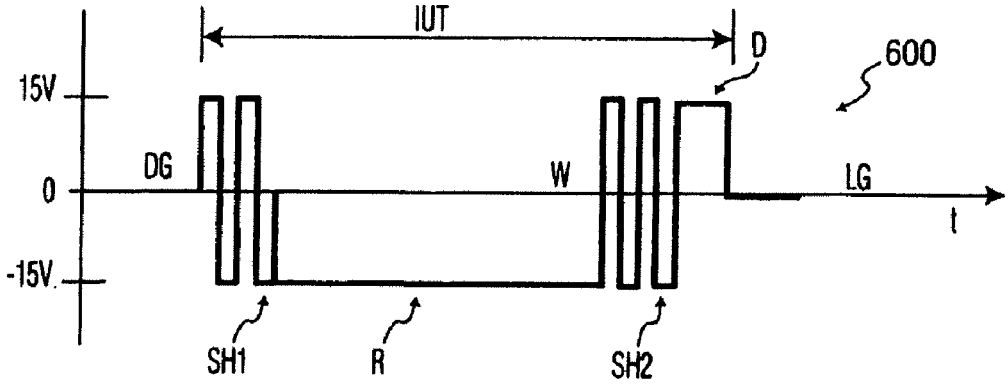
FIG. 6 illustrates an example waveform using rail-stabilized driving, where the waveform includes first shaking pulses, a reset pulse, second shaking pulses, and a driving pulse.
Figure 7:
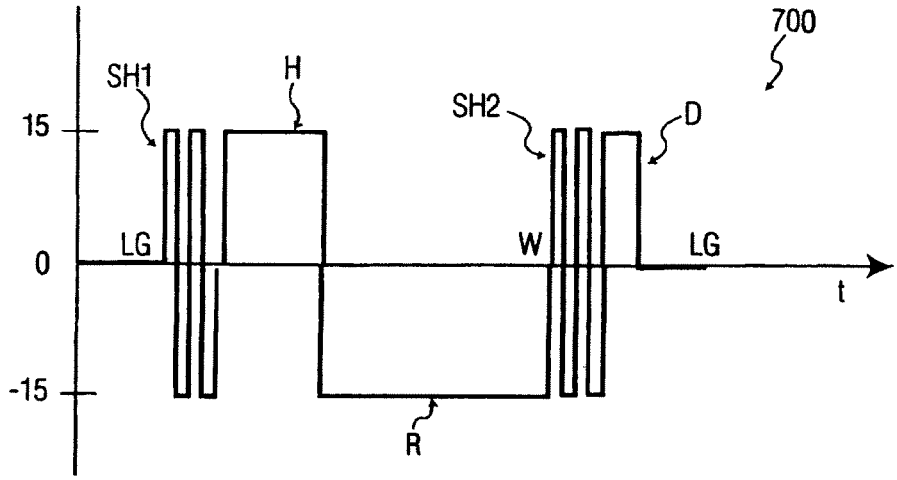
FIG. 7 illustrates an example waveform using rail-stabilized driving, where the waveform includes first shaking pulses, a help reset pulse of opposite polarity to the reset pulse, a reset pulse, second shaking pulses, and a driving pulse.

FIGS. 5-7 illustrate examples of driving waveforms for electrophoretic displays which comprise negatively charged white particles and positively charged black particles. FIG. 5 illustrates an example waveform 500 using rail-stabilized driving, where the waveform includes first shaking pulses (SH1), a reset pulse (R), and a driving pulse (D). FIG. 6 illustrates another example waveform 600 using rail-stabilized driving, where the waveform includes first shaking pulses (SH1), a reset pulse (R), second shaking pulses (SH2), and a driving pulse (D). The waveforms of FIG. 5 and FIG. 6 are discussed in the above-mentioned European patent application EP 03100133.2. This method is schematically shown for an example image transition from dark grey (DG) to light grey (LG) via the white (W) rail. The total image update time (IUT) is the sum of the time periods used in each portion of the waveform 500 or 600. In the waveform 500, the reset pulse (R), which occurs in the time period between $t_1$ and $t_2$, must be longer than the minimum time required for moving the particles from dark grey (DG) state to the white (W) state to ensure that the old image is timely erased during a new image update and that image quality is guaranteed. This minimum time, which is a standard reset duration, corresponds to the time period between $t_1$ and $t'_2$. The time period between $t'_2$ and $t_2$ is an additional reset period, or over reset period, in which no visible optical state changes. The standard reset requires a time period that is proportional to the distance that the particles need to move between two electrodes, while the over-reset is needed for improving the image quality. Shake pulses (SH1, SH2) are used for reducing the dwell time and image history effects, thereby reducing image retention and increasing greyscale accuracy. The driving pulse is required for adding the grey tones by driving the display from the rail state, e.g., white (W), to the desired intermediate greyscale state, such as LG, as indicated.

FIG. 7 illustrates an example waveform 700 using rail-stabilized driving, where the waveform includes first shaking pulses (SH1), a help reset pulse (H) of opposite polarity to a reset pulse (R), a reset pulse (R), second shaking pulses (SH2), and a driving pulse (D). The waveform of the type shown in FIG. 7 is discussed in the above-mentioned European patent application no. 03102139.7. This method is schematically shown for an example image transition from light grey (LG) to light grey (LG) via the white (W) rail. In comparison to the waveform of FIG. 6, the over-reset pulse (R) is preceded by a further reset pulse (help pulse, H) of opposite polarity to the reset pulse (R). The help pulse (H) is designed to allow the black and white particles to interact with each other, whereby a more accurate grey scale level is achievable, and may be of a reduced duration, as it is not designed to bring particles to the rail states. The over reset pulse (R) then resets the display to the white rail state after which the driving pulse (D) is required for adding the grey tones by driving the display from the rail state, e.g., white (W), to the desired intermediate greyscale state, such as LG, as indicated. In one example implementation, the first shaking pulses (SH1) have a duration of 100 ms, the help reset portion (H) has a duration of 150 ms, the reset portion (R) has a duration of 700 ms, and the driving portion (D) has a duration of 100 ms. Second shaking pulses (SH2) are also provided after the reset pulse (R) and prior to the drive pulse (D).

Figure 8:
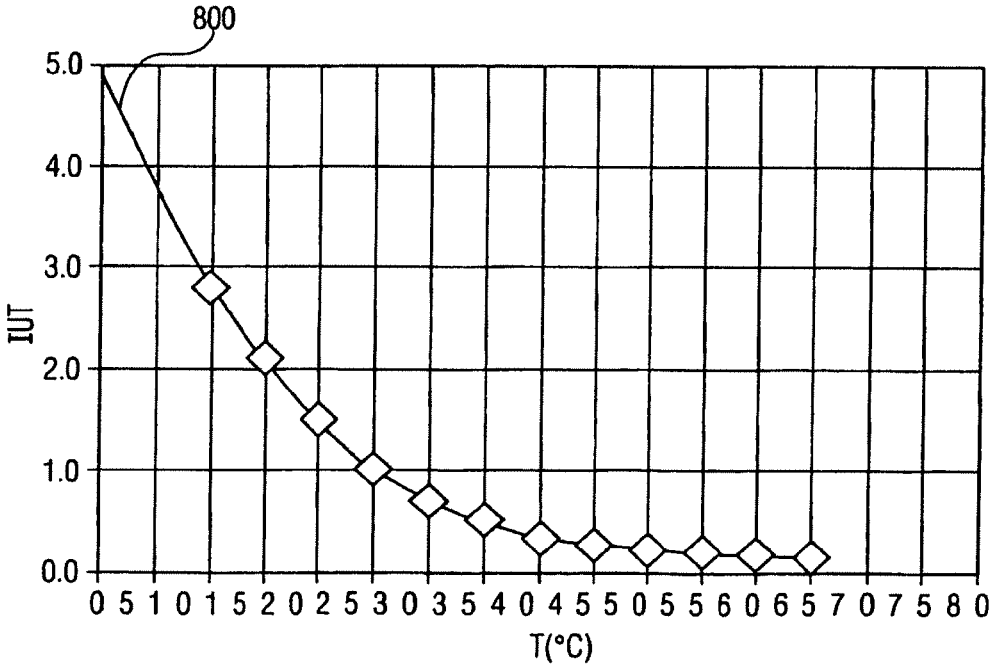
FIG. 8 illustrates a scaling function for total image update time using a single scaling function.

FIG. 8 illustrates a scaling function 800 for total image update time (IUT) using a single scaling function. The scaling function 800 was obtained at the different points represented by diamonds using experimental results between 10 and 65° C. as measured on a display panel using the waveform of FIG. 5. Note that the temperature can be derived from a temperature sensor 335 in the electronic reading device 300, as discussed in connection with FIG. 3. Each data point at the various temperatures (T) was obtained by optimizing the greyscale level and the greyscale accuracy during more than two hundred random image transitions. Based on these experimental data, a fit function was derived as represented by the continuous line. Data for providing the waveforms at the different temperatures can be generated and stored in look-up-tables. In this approach, the single scaling function 800 is applied to the components of the waveform 500 so that the durations of the shaking pulses (SH1), reset pulse (R) and driving pulse (D) are each scaled by the same scaling factor, which is obtained by reading the scaling function 800 at a specified temperature (T).

A scaling factor of unity is obtained at the reference temperature of 25° C. The waveform is optimized for 25° C. with an IUT of 900 ms. At higher temperatures, the IUT decreases while at lower temperatures, the IUT increases rapidly up to a factor of five at 0° C. In particular at 0° C., an IUT of 5×900 ms=4.5 seconds is required, which is unacceptably long. Specifically, for an e-reading device such as an e-book, the IUT should be less than a specified maximum time period such as one second to avoid inconvenient delays for the user. At 65° C., an IUT of about 0.2×900 ms=180 ms is required. However, the greyscale accuracy is marginal in this case. Moreover, the wide range of IUT values over the temperature range can result in unacceptable performance for the user. The technique of the present invention, detailed below, overcomes the disadvantages of the single scaling function approach.

Figure 9:
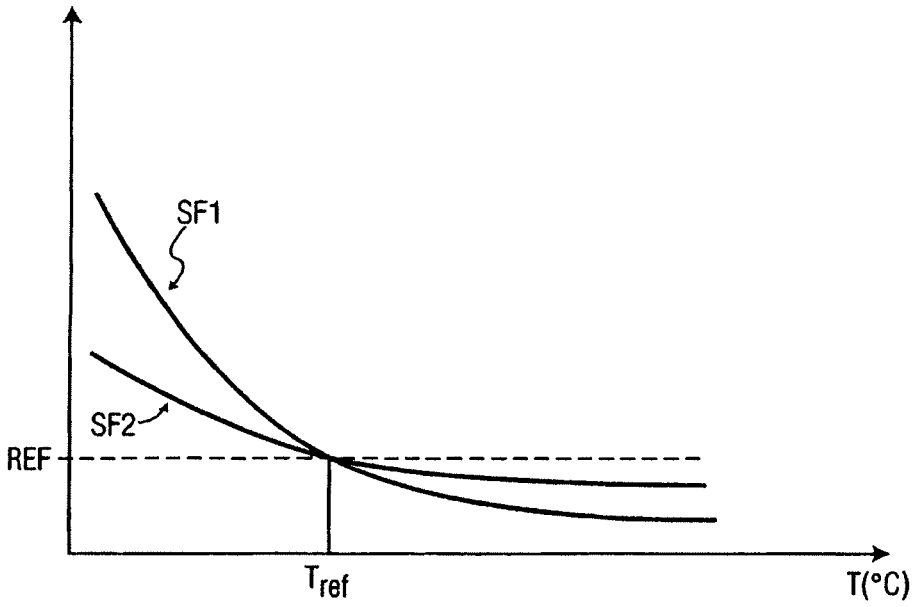
FIG. 9 illustrates separate scaling functions for a driving pulse and a reset pulse.

FIG. 9 illustrates scaling functions for a reset pulse and a driving pulse. The present invention proposes a technique for compensating for the temperature dependence of driving schemes for electrophoretic displays with at least 2-bits greyscale. Specifically, at least two different scaling functions, SF1 and SF2, are used to scale the pulse time of the voltage pulses used in the driving waveforms based on the determined temperature. SF1 is a scaling function for the driving pulse (D), while SF2 is a scaling function for the reset pulse (R). A reference (ref) level of the scaling functions such as unity is applied at the reference temperature ($T_{ref}$), e.g., 25° C. A duration of the reset pulse (R) is determined by scaling a reference reset pulse duration, such as 700 ms, by a scaling factor that is obtained by reading the associated scaling function (SF2) at the determined temperature. Similarly, a duration of the driving pulse (D) is determined by scaling a reference driving pulse duration, such as 100 ms, by a scaling factor that is obtained by reading the associated scaling function (SF1) at the determined temperature.

Generally, the scaling functions SF1 and SF2 account for the change in the particle mobility or the fluid viscosity in the display with temperature. At a colder temperature, the duration of the reset pulse (R) needs to be increased so that the display is reset to the desired rail state, while the duration of the subsequent driving pulse (D) needs to be increased to drive the display to the desired final greyscale state. Note that the absolute value of the slope of SF2 is chosen to be significantly less than that of SF1. In other words, SF1 has a strong temperature dependence, while SF2 has a more gradual temperature dependence. With this approach, the total image update time (IUT) at lower temperatures is largely reduced while a good image quality remains. At the same time, the IUT at higher temperatures remains below the value at the $T_{ref}$. At the higher temperatures, we chose a higher SF2 in order to improve the greyscale accuracy and reduce the overall IUT difference in the temperature range in which the display may be operated. The IUT difference between 0 and 65° C. is massively reduced, compared to the single scaling function 800 of FIG. 8, resulting in a large improvement of the visual perception of the display by the user.

The standard reset pulse time is sensitive to the temperature and strongly related to the fluid viscosity, while the over-reset part is less sensitive to the temperature. Thus, it is most important to scale the standard reset pulse with temperature according to the change of the fluid viscosity, while the over-reset pulse duration is chosen mainly according to the image quality.

Figure 10:
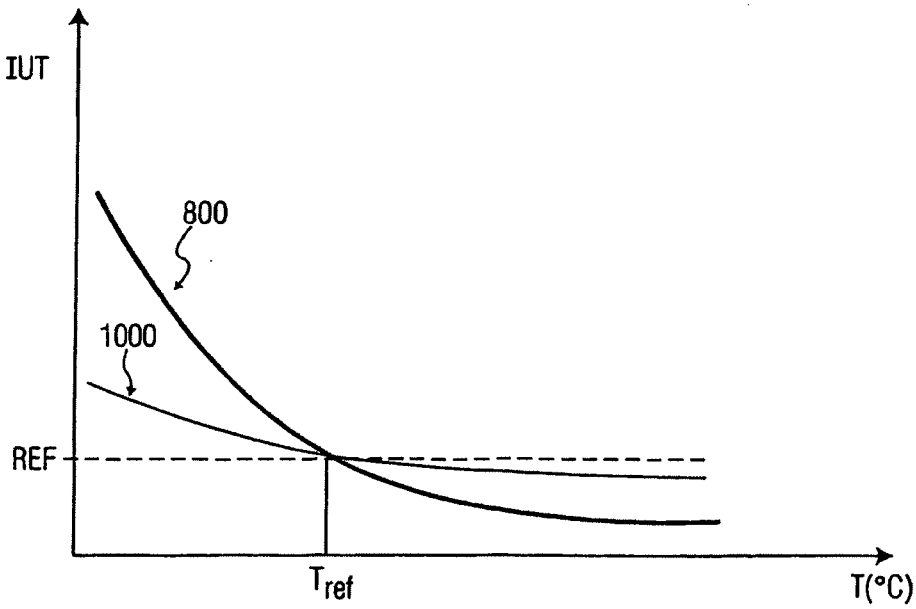
FIG. 10 illustrates variations in total image update time (IUT) with temperature, comparing the IUT with a single scaling function to the IUT with dual scaling functions.

FIG. 10 illustrates variations in total image update time (IUT) with temperature, comparing the IUT with a single scaling function to the IUT with dual scaling functions. The curve 1000 depicts the total image update time (IUT) as a function of temperature (T) according to the invention, and represents a combined result of the two different scaling functions (SF1, SF2) for the driving pulse and the reset pulse, respectively. For comparison, the result using a single scaling function is also shown as curve 800, discussed in connection with FIG. 8.

The time period used in the over-reset pulse may vary, for example, from 1.05 to 3 times the standard reset time. The IUT is mainly determined by the reset pulse duration, which is about 80% of the IUT. A significant reduction of the IUT is realized, particularly at temperatures below the reference temperature ($T_{ref}$). On the other hand, the greyscale accuracy at temperatures above the reference temperature is improved by increasing the time period of the reset pulse. A greater over-reset is desired relative to the driving pulse at higher temperatures because of the high mobility of particles and ions or low fluid viscosity. It is also allowable to have a longer IUT at these temperatures, compared to the single-scaling function curve 800, as long as the IUT is below the IUT at $T_{ref}$. A small deviation from the reference IUT level (ref) is created in the range of temperatures above $T_{ref}$.

For example, a waveform may be optimized for a reference temperature of 25° C. with an IUT of 900 ms, including a shaking portion of 100 ms duration, a driving portion of 100 ms duration, and a reset portion of 700 ms duration. The saturation time of the ink or other bi-stable material is about 200 ms, which is the standard reset time. When this waveform is extended to 0° C. using the single scaling function curve 800, the ITU increases by a factor of five. It was demonstrated that the duration of shaking pulses may remain the same or be reduced at lower temperatures. For simplicity in this example, a constant shaking pulse time is used. The IUT becomes 100 ms+5×700 ms+5×100 ms=4100 ms. However, when the over-reset is only scaled by a factor of 1.5, this leads to a scaling factor (5×200 ms+1.5×500 ms)/700=2.5 for the reset pulse. Now, the IUT becomes 100 ms+2.5×700 ms+5×100 ms=2350 ms, which represents a significant reduction.

It is also possible to have more than two scaling functions for scaling a waveform with temperature. For example, separate scaling functions may be provided for scaling the durations of the standard reset pulse, the over-reset pulse, the help reset pulse and the driving pulse. Separate scaling functions may be provided additionally for the first and/or second shaking pulses. An example is given in FIG. 11.

Figure 11:
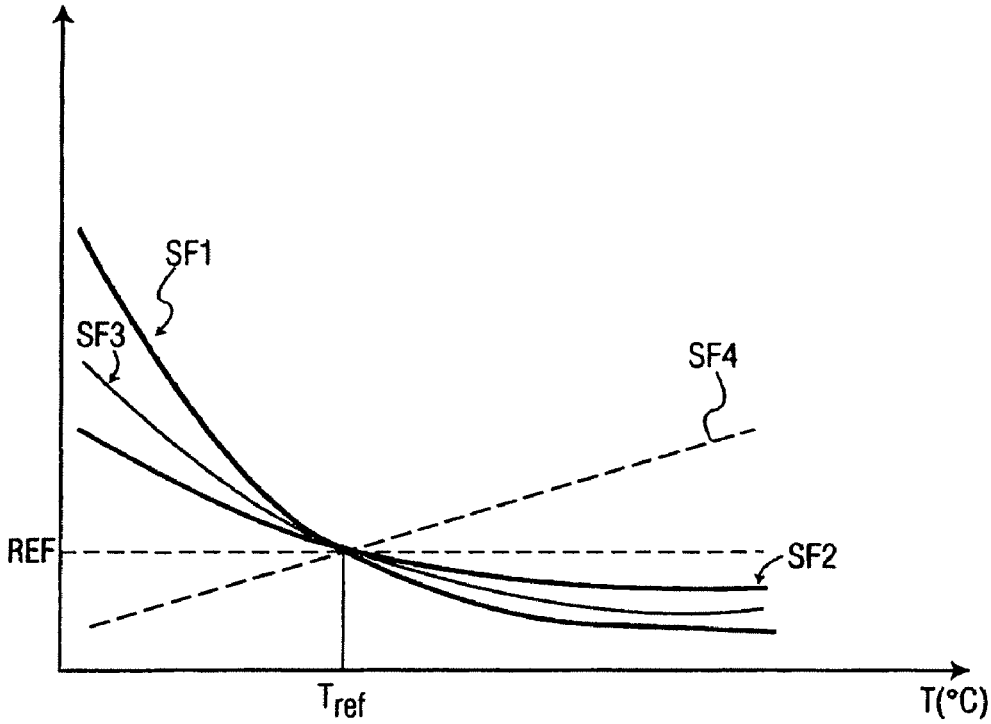
FIG. 11 illustrates separate scaling functions for a reset pulse, help reset pulse, shaking pulse and a driving pulse.

FIG. 11 illustrates separate scaling functions for a reset pulse, help reset pulse, shaking pulse and a driving pulse. SF1, SF2, SF3 and SF4 denote the scaling functions for the drive pulse (D), reset pulse (R), help reset pulse (H), and shaking pulse, respectively. Here, the shaking pulses display a temperature scaling factor (SF4) which increases with increasing temperature, while the help reset pulse (H) has a temperature scaling factor (SF3) which lies between that of the drive (SF1) and the over reset (SF2) pulses.

Generally, separate scaling functions may also be provided for different image transitions, e.g., black to white, black to dark grey, etc. Also, the reference pulse durations that are scaled by the scaling functions can differ for different display update scenarios, such as updating images that comprise intermediate grey scale levels as compared to updating images that consist entirely of either black or white pixels. In practice, data for providing the waveforms at the different temperatures can be generated beforehand based on the scaling functions and stored in look-up-tables. Limitations on memory and processing resources may limit the number and/or complexity of the scaling functions used.

Note that, in the above examples, pulse-width modulated (PWM) driving is used for illustrating the invention, where the pulse time is varied in each waveform while the voltage amplitude is kept constant. However, the invention is also applicable to other driving schemes, e.g., based on voltage modulated driving (VM), where the pulse voltage amplitude is varied in each waveform, or combined PWM and VM driving. The invention is applicable to color as well as grey-scale bi-stable displays. Also, the electrode structure is not limited. For example, a top/bottom electrode structure, honeycomb structure in-plane switching structures or other combined in-plane-switching and vertical switching may be used. Moreover, the invention may be implemented in passive matrix as well as active matrix electrophoretic displays. In fact, the invention can be implemented in any bi-stable display, e.g., any display that does not consume power while the image substantially remains on the display after an image update. Also, the invention is applicable to both single and multiple window displays, where, for example, a typewriter mode exists.

While there has been shown and described what are considered to be preferred embodiments of the invention, it will, of course, be understood that various modifications and changes in form or detail could readily be made without departing from the spirit of the invention. It is therefore intended that the invention not be limited to the exact forms described and illustrated, but should be construed to cover all modifications that may fall within the scope of the appended claims.

The invention claimed is:

1. A method for driving a bi-stable display, comprising:

determining a temperature (T) associated with the bi-stable display (310);

determining a duration for applying a reset pulse (R) to at least a portion of the bi-stable display based on the determined temperature and a first scaling function (SF2); and determining a duration for applying a driving pulse (D) to the at least a portion of the bi-stable display based on the determined temperature and a second scaling function that differs from the first scaling function (SF2), wherein an absolute value of a slope of the first scaling function with varying temperature is less than an absolute value of a slope of the second scaling function when the determined temperature is below a reference temperature ($T_{ref}$).

2. The method of claim 1, wherein:

the determining the duration for applying the reset pulse comprises determining a first scaling factor according to the first sealing function (SF2) and the determined temperature (T), and scaling a reference reset pulse duration by the first scaling factor; and the determining the duration for applying the driving pulse comprises determining a second scaling factor according to the second scaling function (SF1) and the determined temperature (T), and scaling a reference driving pulse duration by the second scaling factor; wherein the first scaling factor is less than the second sealing factor when the determined temperature is below a reference temperature ($T_{ref}$).

3. The method of claim 1, further comprising:

determining a duration for applying shaking pulses (SH1, SH2) to the at least a portion of the bi-stable display based on the determined temperature and a further scaling function (SF4).

4. The method of claim 3, wherein:

the further scaling function (SF4) has an opposite slope with varying temperature than slopes of the first and second sealing functions over at least a portion of a temperature range.

5. The method of claim 1, further comprising:

determining a duration for applying a help pulse (H), prior to the reset pulse, to the at least a portion of the bi-stable display based on the determined temperature and a further scaling function (SF3).

6. The method of claim 5, wherein:

the further sealing function (SF3) lies between the first (SF2) and the second (SF1) scaling factors.

7. The method of claim 1, wherein:

the bi-stable display comprises an electrophoretic display.

8. A program storage device tangibly embodying a program of instructions executable by a machine to perform a method for updating an image on a bi-stable display, the method comprising:

determining a temperature(T) associated with the bi-stable display(310);

determining a duration for applying a reset pulse (R) to at least a portion of the bi-stable display based on the determined temperature and a first scaling function (SF2); and determining a duration for applying a driving pulse (D) to the at least a portion of the bi-stable display based on the determined temperature and a second scaling function (SF1) that differs from the first scaling function (SF2), wherein an absolute value of a slope of the first scaling function with varying temperature is less than an absolute value of a second scaling function when the determined temperature is below a reference temperature ($T_{ref}$).

9. The program storage device of claim 8, wherein:

the determining the duration of the reset pulse comprises determining a first scaling factor according to the first scaling function (SF2) and the determined temperature (T), and scaling a reference reset pulse duration by the first scaling factor; and the determining the duration of the driving pulse comprises determining a second scaling factor according to the second scaling function (SF1) and the determined temperature (T), and scaling a reference driving pulse duration by the second scaling factor; wherein the first scaling factor is less than the second scaling factor when the determined temperature is below a reference temperature ($T_{ref}$).

10. The program storage device of claim 8, wherein the method further comprises:

determining a duration for applying shaking pulses (SH1, SH2) to the at least a portion of the bi-stable display based on the determined temperature and a further scaling function (SF4).

11. The program storage device of claim 8, wherein the method further comprises:

determining a duration cur applying a help pulse (H), prior to the reset pulse, to the at least a portion of the bi-stable display based on the determined temperature and a further scaling function (SF3).

12. The program storage device of claim 8, wherein:

the bi-stable display comprises an electrophoretic display.

13. An electronic reading device, comprising: a bi-stable display (310); and a control (100) for updating an image on the bi-stable display by: (a) determining a temperature (T) associated with the bi-stable display, (b) determining a duration for applying a reset pulse (R) to at least a portion of the bi-stable display based on the determined temperature and a first scaling function (SF2), and (e) determining a duration for applying a driving pulse (D) to the at least a portion of the bi-stable display based on the determined temperature and a second scaling function (SF1) that differs from the first scaling function, wherein an absolute value of a slope of the first scaling function with varying temperature is less than an absolute value of a slope of the second scaling function when the determined temperature is below a reference temperature ($T_{ref}$).

14. The electronic reading device of claim 13, wherein:

the determining the duration of the reset pulse comprises determining a first scaling factor according to the first scaling function and the determined temperature, and scaling a reference reset pulse duration by the first scaling factor; and the determining the duration of the driving pulse comprises determining a second sealing factor according to the second scaling function and the determined temperature, and scaling a reference driving pulse duration by the second scaling factor; wherein the first scaling factor is less than the second scaling factor when the determined temperature is below a reference temperature ($T_{ref}$).

15. The electronic reading device of claim 13, wherein the control updates the image on the bi-stable display by determining a duration for applying shaking pulses (SH1, SH2) to the at least a portion of the bi-stable display based on the determined temperature and a further scaling function (SF4).

16. The electronic reading device of claim 13, wherein the control updates the image on the bi-stable display by determining a duration for applying a help pulse (H), prior to the reset pulse, to the at least a portion of the bi-stable display based on the determined temperature and a further scaling function (SF3).

17. The electronic reading device of claim 13, wherein:

the bi-stable display comprises an electrophoretic display.

* * * * *